US012704034B2

(12) United States Patent
Russell et al.

(10) Patent No.: US 12,704,034 B2
(45) **Date of Patent: *Aug. 11, 2026**

(54) INDEXING CONTROL SYSTEM

(71) Applicant: Arrival Energy Solutions, Inc., Leduc (CA)

(72) Inventors: Jayson Russell, Leduc (CA); Laurier E. Comeau, Calgary (CA); Paul Allan Sibbald, Leduc (CA)

(73) Assignee: ARRIVAL ENERGY SOLUTIONS INC., Leduc (CA)

( * ) Notice: Subject to any disclaimer, the term of this patent is extended or adjusted under 35 U.S.C. 154(b) by 0 days.

This patent is subject to a terminal disclaimer.

(21) Appl. No.: 19/174,556

(22) Filed: Apr. 9, 2025

(65) Prior Publication Data

US 2025/0237114 A1 Jul. 24, 2025

Related U.S. Application Data

(63) Continuation of application No. 18/051,277, filed on Oct. 31, 2022, now Pat. No. 12,331,604.

(51) Int. Cl.
*E21B 23/00* (2006.01)
*E21B 17/10* (2006.01)

(52) U.S. Cl.
CPC ..... *E21B 23/006* (2013.01); *E21B 17/1014* (2013.01); *E21B 23/004* (2013.01)

(58) Field of Classification Search
CPC ... E21B 23/004; E21B 23/006; E21B 17/1014
See application file for complete search history.

(56) References Cited

U.S. PATENT DOCUMENTS

| | | | | |
|---|---|---|---|---|
| 4,415,205 | A * | 11/1983 | Rehm | E21B 41/0035 299/5 |
| 4,895,214 | A * | 1/1990 | Schoeffler | E21B 23/006 175/73 |
| 6,328,119 | B1 * | 12/2001 | Gillis | E21B 7/062 175/325.1 |
| 8,863,843 | B2 | 10/2014 | Wu et al. | |
| 8,936,099 | B2 | 1/2015 | Hu | |
| 9,428,962 | B2 | 8/2016 | Mahajan et al. | |
| 9,683,434 | B2 | 6/2017 | Machocki | |
| 10,954,725 | B2 * | 3/2021 | Crowther | E21B 7/062 |
| 11,118,408 | B2 | 9/2021 | Marshall et al. | |
| 12,049,823 | B2 * | 7/2024 | McCullough | E21B 17/05 |
| 12,331,604 | B2 * | 6/2025 | Russell | E21B 23/006 |
| 2014/0353041 | A1 | 12/2014 | Hu | |
| 2015/0014061 | A1 | 1/2015 | Wu et al. | |
| 2015/0144401 | A1 | 5/2015 | Nagaraj et al. | |

(Continued)

FOREIGN PATENT DOCUMENTS

| | | | |
|---|---|---|---|
| WO | 2016003396 | A1 | 1/2016 |
| WO | 2016167764 | A1 | 10/2016 |

*Primary Examiner* — Yong-Suk (Philip) Ro
(74) *Attorney, Agent, or Firm* — Cabello Hall Zinda PLLC

(57) ABSTRACT

A downhole tool assembly is configured for repeated and selective hydraulic activation and deactivation. A spring member biases the indexing control section 210 towards a first axial position while drilling fluid pressure in the tool body urges the indexing control section 210 towards other axial positions. Downhole tool activation and deactivation may repeatedly be controlled from the surface by cycling the drilling fluid pressure.

22 Claims, 14 Drawing Sheets

(56) References Cited

U.S. PATENT DOCUMENTS

| | | | | |
|---|---|---|---|---|
| 2015/0292281 | A1 | 10/2015 | Hardin, Jr. et al. | |
| 2016/0130897 | A1 | 5/2016 | Machocki | |
| 2016/0362962 | A1* | 12/2016 | Gonzalez | E21B 21/103 |
| 2018/0238131 | A1 | 8/2018 | Mackenzie et al. | |
| 2020/0263507 | A1 | 8/2020 | Crowther et al. | |

* cited by examiner

INDEXING CONTROL SYSTEM

CROSS-REFERENCE TO RELATED APPLICATIONS

This application is a continuation of U.S. application Ser. No. 18/051,277 filed Oct. 31, 2022, which is incorporated herein by reference in its entirety.

TECHNICAL FIELD

The present invention relates to the field of directional drilling, and in particular to a system for repeatedly activating and deactivating tools for use in downhole drilling operations without having to break or trip a tool string.

BACKGROUND ART

Downhole drilling operations commonly require a downhole tool to be activated after the tool has been deployed in the borehole. For example, stabilizers are commonly tripped into the borehole in a collapsed state (i.e., with the stabilizer structures retracted into the stabilizer tool body). At some predetermined depth, the stabilizer is activated such that the stabilizer structures expand radially outward from the tool body. Hydraulic activation mechanisms are well known in oilfield services operations and are commonly employed, and even desirable, in such operations.

For example, one well-known hydraulic activation methodology involves dropping an object such as a dart through the interior of the drill string to enable differential hydraulic pressure to activate a downhole tool. Upon completion of the tool's operation, the tool may be deactivated by retrieving the dart using wireline techniques. While commercially serviceable, wireline activation and deactivation are both expensive and time-consuming in that it requires concurrent use of wireline or slickline assemblies.

Another commonly used hydraulic activation methodology makes use of shear pins configured to shear at a specific differential pressure (or in a predetermined range of pressures). Ball drop mechanisms are also known in the art, in which a ball is dropped down through the drill string to a ball seat. Engagement of the ball with the seat typically causes an increase in differential pressure which in turn activates the downhole tool. The tool may be deactivated by increasing the pressure beyond a predetermined threshold such that the ball and ball seat are released (e.g., via the breaking of shear pins). While such shear pin and ball drop mechanisms are also commercially serviceable, they are generally one-time or one-cycle mechanisms (or at least small numbers of cycles) and do not typically allow for unlimited repeated activation and deactivation of a downhole tool.

Various other hydraulic activation mechanisms make use of measurement while drilling (MWD) and/or other electronically controllable systems including, for example, computer controllable solenoid valves and the like. Electronic activation advantageously enables a wide range of activation and deactivation instructions to be executed and may further enable two-way communication with the surface. However, these activation systems tend to be highly complex and expensive and can be severely limited by the reliability and accuracy of MWD, telemetry, and other electronically controllable systems deployed in the borehole. As a result, there are many applications in which their use tends to be undesirable.

There remains a need in the art for a hydraulic activation assembly that enables a downhole tool, such as a stabilizer or reamer, to be repeatedly activated and deactivated any desired number of times during a drilling operation without breaking the tool string or tripping the tool out of the borehole. Such an assembly is preferably purely mechanical and therefore does not require the use of electronically controllable components.

SUMMARY OF INVENTION

In a first aspect, an indexing control system for a downhole tool comprises: an outer mandrel; an inner mandrel, disposed within the outer mandrel; a barrel cam, disposed on and affixed to the inner mandrel, comprising: a body, disposed on and affixed to the inner mandrel; a cam track formed in the body, comprising: a first loop track; a second loop track; and a transition track connecting the first loop track and the second loop track; and a pin, disposed on the outer mandrel, configured to engage the cam track, wherein a first downhole fluid pressure urges the barrel cam in a downhole direction, causing the pin to traverse a first portion of the first loop track from a first resting position to a second resting position, wherein a second downhole fluid pressure allows the barrel cam to move in an uphole direction, causing the pin to traverse a second portion of the first loop track from the second resting position to the first resting position, wherein a third downhole fluid pressure urges the barrel cam to move in a downhole direction, causing the pin to traverse a part of the first portion of the first loop track from the first resting position, and wherein a fourth downhole fluid pressure allows the barrel cam to move in an uphole direction, causing the pin to traverse the part of the first portion of the first loop track in a reverse direction and traverse the transition track toward the second loop track.

In a second aspect, a downhole tool assembly comprises: an outer mandrel; an indexing control system, comprising: an inner mandrel, disposed within the outer mandrel; a barrel cam, disposed on and affixed to the inner mandrel, comprising: a body, disposed on and affixed to the inner mandrel; a cam track formed in the body, comprising: a first loop track; and a transition track connecting the first loop track and a second loop track; and a pin, disposed on the outer mandrel, configured to engage the cam track; and a downhole tool connected to the outer mandrel, configured for activation and deactivation by the indexing control system, wherein a first downhole fluid pressure urges the barrel cam in a downhole direction, causing the pin to traverse a first portion of the first loop track from a first resting position to a second resting position, wherein a second downhole fluid pressure allows the barrel cam to move in an uphole direction, causing the pin to traverse a second portion of the first loop track from the second resting position to the first resting position, wherein a third downhole fluid pressure urges the barrel cam to move in a downhole direction, causing the pin to traverse a part of the first portion of the first loop track from the first resting position, and wherein a fourth downhole fluid pressure allows the barrel cam to move in an uphole direction, causing the pin to traverse the part of the first portion of the first loop track in a reverse direction and traverse the transition track toward the second loop track.

In a third aspect, a method of repeatedly activating and deactivating a downhole tool comprises: moving a pin in a first loop track of a cam track of a barrel cam, causing uphole and downhole movement of the barrel cam; moving the pin through a transition track of the cam track from the first loop track to a second loop track of the cam track; moving the pin in the second loop track, causing uphole and downhole movement of the barrel cam; and activating and deactivating the downhole tool by the uphole and downhole movement of the barrel cam, wherein moving the pin is caused by increasing or decreasing downhole fluid pressure.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts are understood to reference all instances of subscripts corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

As used herein, satisfying a threshold may, depending on the context, refer to a value being greater than the threshold, greater than or equal to the threshold, less than the threshold, less than or equal to the threshold, equal to the threshold, or the like, depending on the context.

Although particular combinations of features are recited in the claims and disclosed in the specification, these combinations are not intended to limit the disclosure of various implementations. Features may be combined in ways not specifically recited in the claims or disclosed in the specification.

Although each dependent claim listed below may directly depend on only one claim, the disclosure of various implementations includes each dependent claim in combination with every other claim in the claim set. No element, act, or instruction used herein should be construed as critical or essential unless explicitly described as such.

Figure 1:
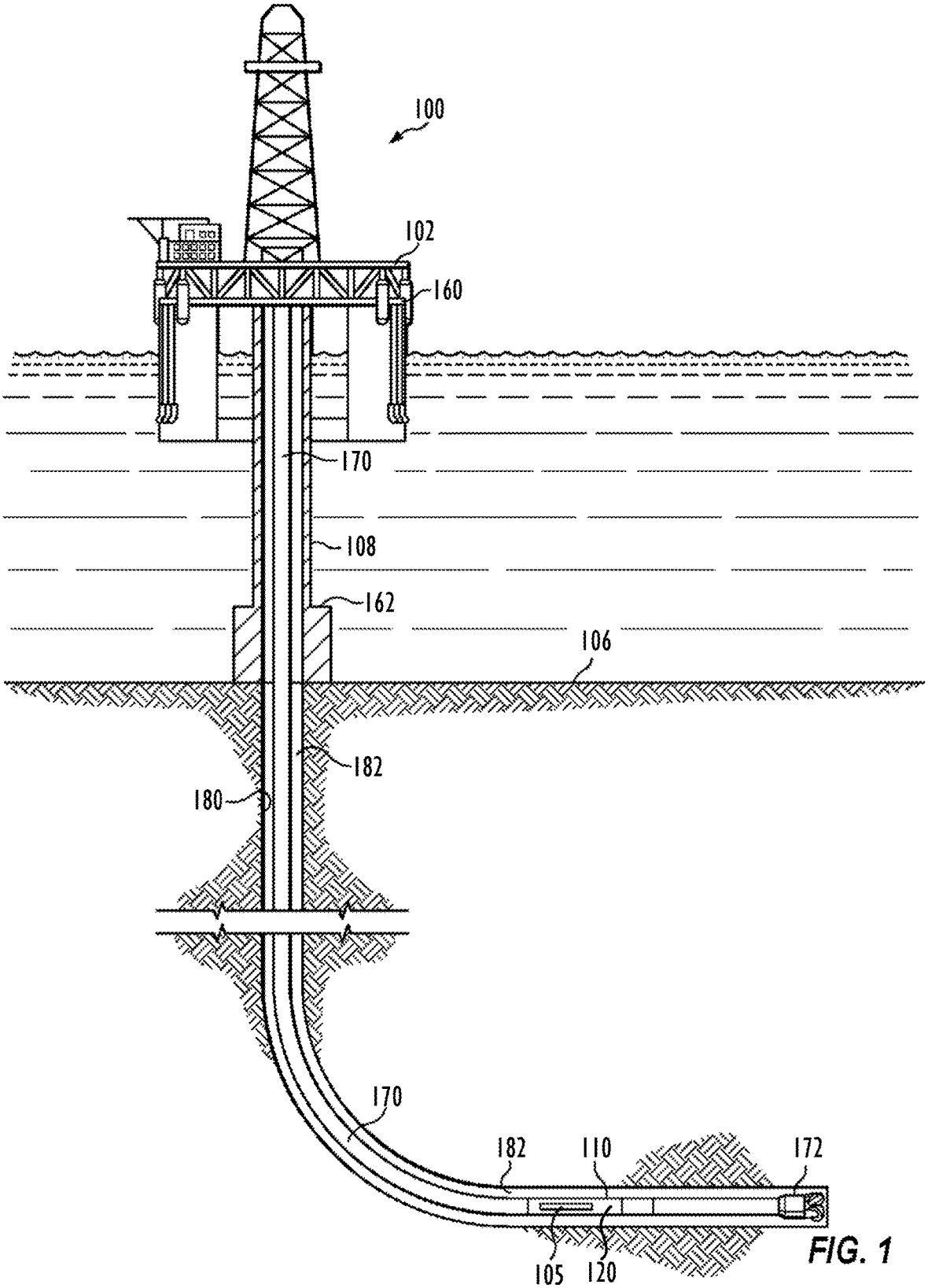
FIG. 1 is a cutaway view of a conventional drilling rig on which embodiments of a downhole tool including an indexing control system may be utilized.

FIG. 1 illustrates an offshore drilling assembly 100 suitable for use with downhole tool embodiments as described below. As illustrated in FIG. 1, a semi-submersible drilling platform 102 is positioned over an oil or gas formation (not shown) disposed below the sea floor 106. A subsea conduit 108 extends from deck 160 of semi-submersible drilling platform 102 to a wellhead installation 162. The semi-submersible drilling platform 102 may include a derrick and a hoisting apparatus for raising and lowering the drill string 170, which, as illustrated, extends into borehole 180 and includes a drill bit 172 and a hydraulically activated tool assembly 110 configured as described below deployed above the drill bit 172. The drill string 170 may optionally further include substantially any number of other downhole tools including, for example, measurement while drilling (MWD) or logging while drilling (LWD) tools, reamers, a drilling jar, a rotary steerable tool, and a downhole drilling motor. The tool assembly 110 may be deployed in substantially any location along the string, for example, just above the drill bit 172 or further uphole above various MWD and LWD tools.

During a typical drilling operation, drilling fluid (commonly referred to as "mud" in the art) is pumped downward through the drill string 170 and the bottom hole assembly (BHA) where it emerges at or near the drill bit 172 at the bottom of the borehole 180. The mud serves several purposes, including cooling and lubricating the drill bit 172, clearing cuttings away from the drill bit 172 and transporting them to the surface, and stabilizing and sealing the formations through which the borehole 180 traverses. The discharged mud, along with the borehole cuttings and sometimes other borehole fluids, then flows upward through the annulus 182 (the space between the drill string 170 and the borehole wall) to the surface. In various embodiments, tool assembly 110 makes use of the differential pressure between an internal flow channel and the annulus to selectively activate and deactivate certain tool functionality (e.g., the radial extension of a stabilizer structure outward from a tool body).

Those of ordinary skill in the art will understand that the deployment illustrated in FIG. 1 is merely illustrative and by way of example only. The embodiments described below are not limited to use with a semi-submersible drilling platform 102 as illustrated in FIG. 1, but may equally be used with any kind of subterranean drilling operation, either offshore or onshore.

In one embodiment, tool assembly 110 may include a downhole tool such as a stabilizer configured for selective hydraulic activation and deactivation. As used herein, activating and deactivating means that features of the downhole tool may move relative to a tool body 120. For example, stabilizer structures 105 may be extended radially outward from the tool body 120 and retracted radially inward towards (or into) the tool body 120.

Turning now to FIGS. 2-6 cutaway views of a downhole tool assembly 200 according to one embodiment, in this example an adjustable stabilizer, illustrated in a variety of states. In FIGS. 2-6, the downhole tool assembly 200 is an adjustable stabilizer. However, as stated above, different types of downhole tools may be implemented using the techniques illustrated herein, including a reamer and a flow bypass assembly.

In FIGS. 2-6, the example downhole tool assembly 200 is comprised of three major sections: an indexing control section 210, a stabilizer section 220, and a fluid flow control section 230. Where the downhole tool assembly comprises a different type of downhole tool, such as a reamer, either or both of the stabilizer section 220 and the fluid flow control section 230 may be replaced with appropriate features for the other type of tool. A spring member biases the indexing control section 210 towards a first axial position while drilling fluid pressure in the tool body urges the indexing control section 210 towards other axial positions.

Indexing control section 210 may comprise a barrel cam 215, a pin 216 for engaging with the barrel cam 215, a first spring 217, and a second spring 219. The first spring 217 has a lower spring force than the second spring 219, as will be described in more detail below. The first spring 217 and the second spring 219 are biased to urge the barrel cam 215 in an uphole direction. The barrel cam 215, first spring 217, and second spring 219 are disposed on and affixed to an inner mandrel 260 between the inner mandrel 260 and an outer mandrel 250. The pin 216 is disposed through the outer mandrel 250, which holds the pin 216 in place during operation of the downhole tool assembly 200. Pin 216 is spring loaded, allowing pin 216 to stay engaged with tracks of varying depth in the barrel cam 215. In operation, the barrel cam 215 rotates and moves axially as urged by the pin 216, which moves within grooves formed on the circumference of the barrel cam 215, as described in more detail below. Downhole movement of the barrel cam 215 axially is caused by downhole fluid pressure urging the barrel cam 215 and inner mandrel 260 against the first spring 217 and second spring 219. The first spring 217 is mounted on a downhole portion of the barrel cam 215 and compresses against a sleeve 218 so that compression of the second spring 219 does not occur until the first spring 217 is compressed into the sleeve 218 so that the barrel cam 215 bears on the sleeve 218. The sleeve 218 is urged in an uphole direction by the second spring 219, with uphole movement of the sleeve 218 limited by stop pin 211. A pin 212 prevents downhole movement of the second spring 219. When the first spring 217 is compressed into the sleeve 218 far enough that the barrel cam 215 engages with the sleeve 218, further downhole movement of the barrel cam 215 causes the sleeve 218 to compress the second spring 219. When pumps are off, the second spring 219 urges the sleeve 218 against the stop pin 211 and the first spring 217 urges the barrel cam 215 uphole. By using two springs of different spring forces, finer control of the movement of the inner mandrel 260 may be achieved. However, embodiments of the downhole tool assembly may be manufactured with only a single spring, instead of two springs as illustrated and described herein.

Although a single pin 216 is illustrated in the FIGS. 2-6, one of skill in the art will understand that a plurality of pins 216 may be employed about the circumference of the outer mandrel 250, each of which engages with the grooves formed on the circumference of the barrel cam 215. Similarly, although a single stop pin 211 is illustrated in FIGS. 2-6, a plurality of stop pins 211 may be employed.

As illustrated in FIGS. 2-6, the stabilizer section 220 comprises a plurality of pistons 224 that extend radially outward and retract radially inward through the outer mandrel 250 as urged by ramps 222 that are disposed on the inner mandrel 260. The ramps 222 engage with the pistons 224 responsive to downhole movement of the barrel cam. Any desired number of pistons 224 may be implemented at any desired circumferential position about the stabilizer section 220. Examples of drilling stabilizers may be found in U.S. Pat. No. 8,448,722, entitled "Drilling Stabilizer" and issued May 28, 2013, U.S. Pat. No. 10,954,725, entitled "Multiple Position Drilling Stabilizer" and issued Mar. 23, 2021, both of which are incorporated by reference herein in their entirety. The specific structure of the stabilizer section 220 that causes the pistons 224 to extend and retract is by way of example and other mechanisms for causing the pistons 224 to extend and retract may be used as desired.

As illustrated in FIGS. 2-6, the fluid flow control section 230 comprises a poppet 232 that is disposed on and moves axially with the inner mandrel 260 to engage and disengage with an orifice 234 to control fluid pressure in the downhole tool assembly 200. As illustrated in FIGS. 2-6, the orifice 234 may be disposed in an orifice member 236 that is connected to the outer mandrel 250, allowing easy replacement of the orifice 234 when erosion of the orifice 234 occurs.

Figure 2:
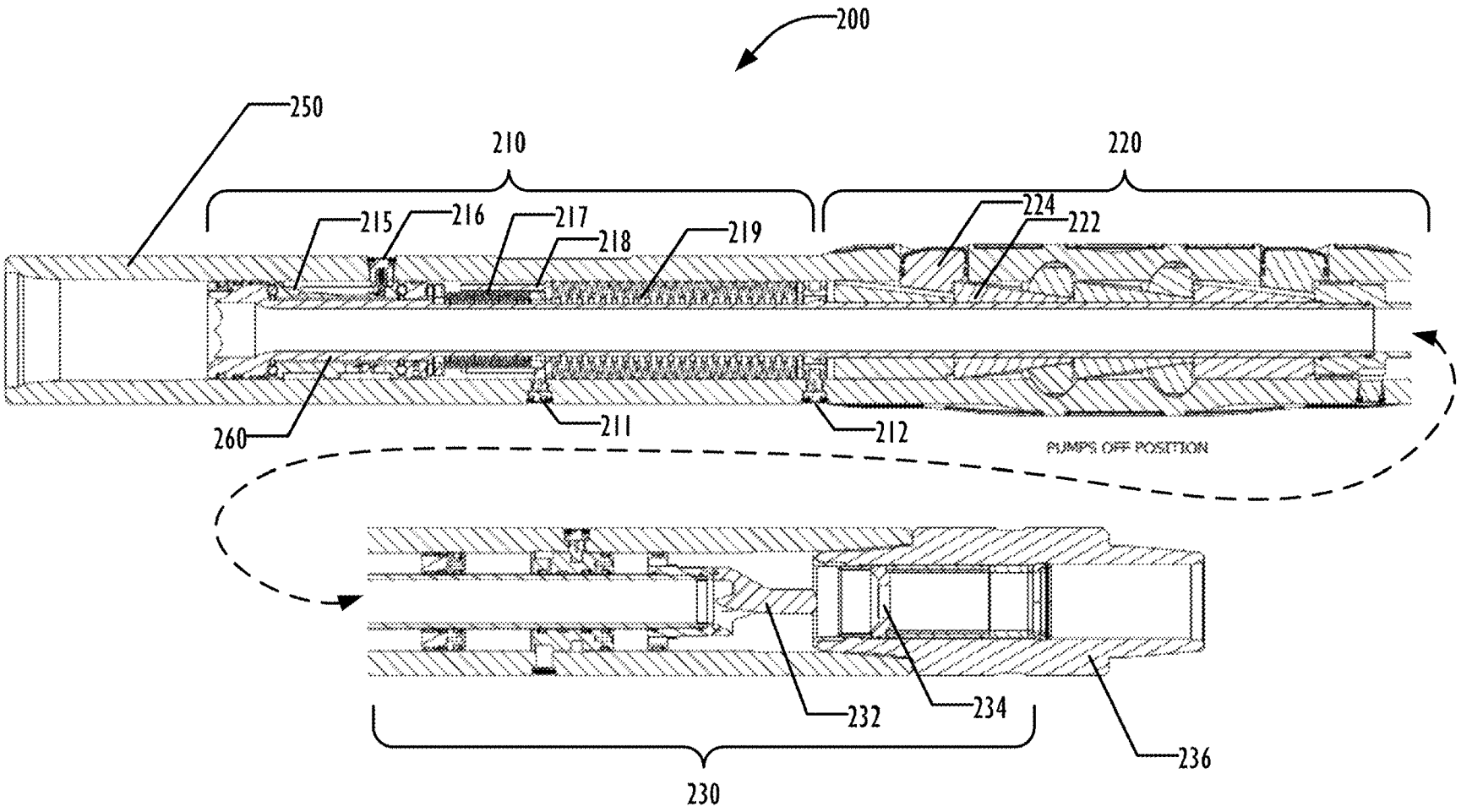
FIGS. 2-6 are cutaway views of a downhole tool including an indexing control system according to one embodiment in various operational positions.

FIG. 2 illustrates the downhole tool assembly 200 in a pumps-off position when mud pumps at the surface are turned off, reducing fluid pressure in the drill string against the inner mandrel 260 and barrel cam 215. In that position, the first spring 217 and the second spring 219 decompress, urging the barrel cam 215 uphole, along with the inner mandrel 260 and the features disposed on the inner mandrel 260. In this position, the poppet 232 does not engage with the orifice 234. The ramps 222 are not urging the pistons 224 radially outward in this position.

Figure 3:
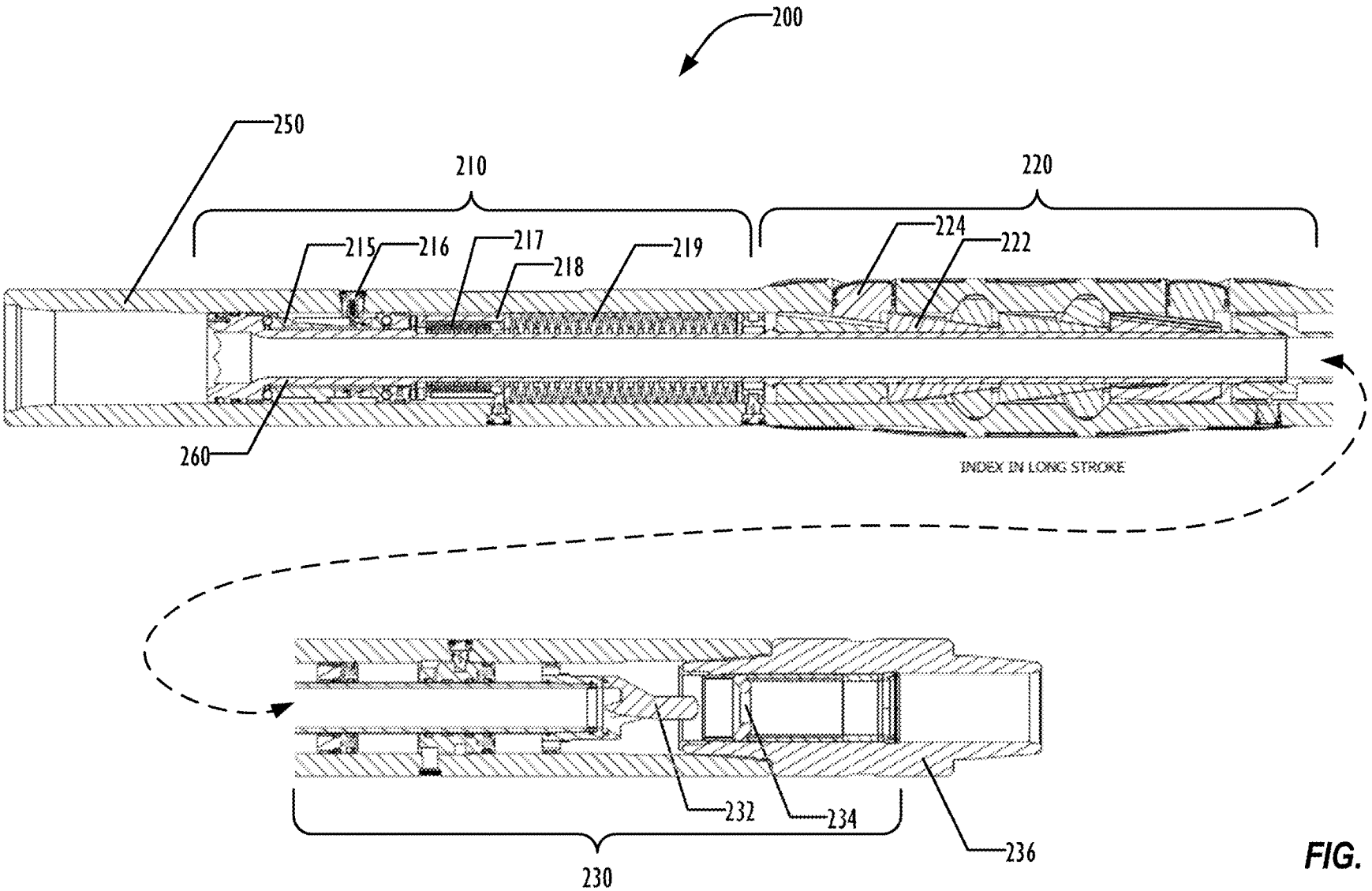

FIG. 3 illustrates the downhole tool assembly 200 indexed in a long stroke position (in long loop track 830, as illustrated in FIGS. 8-12) in which the first spring 217 is compressed into sleeve 218, but the pressure is not sufficient to compress the second spring 219. In this position, the poppet 232 does not engage with the orifice 234. The ramps 222 are partially urging the pistons radially outward in this position, but the pistons 224 do not extend out of the outer mandrel 250.

Figure 4:
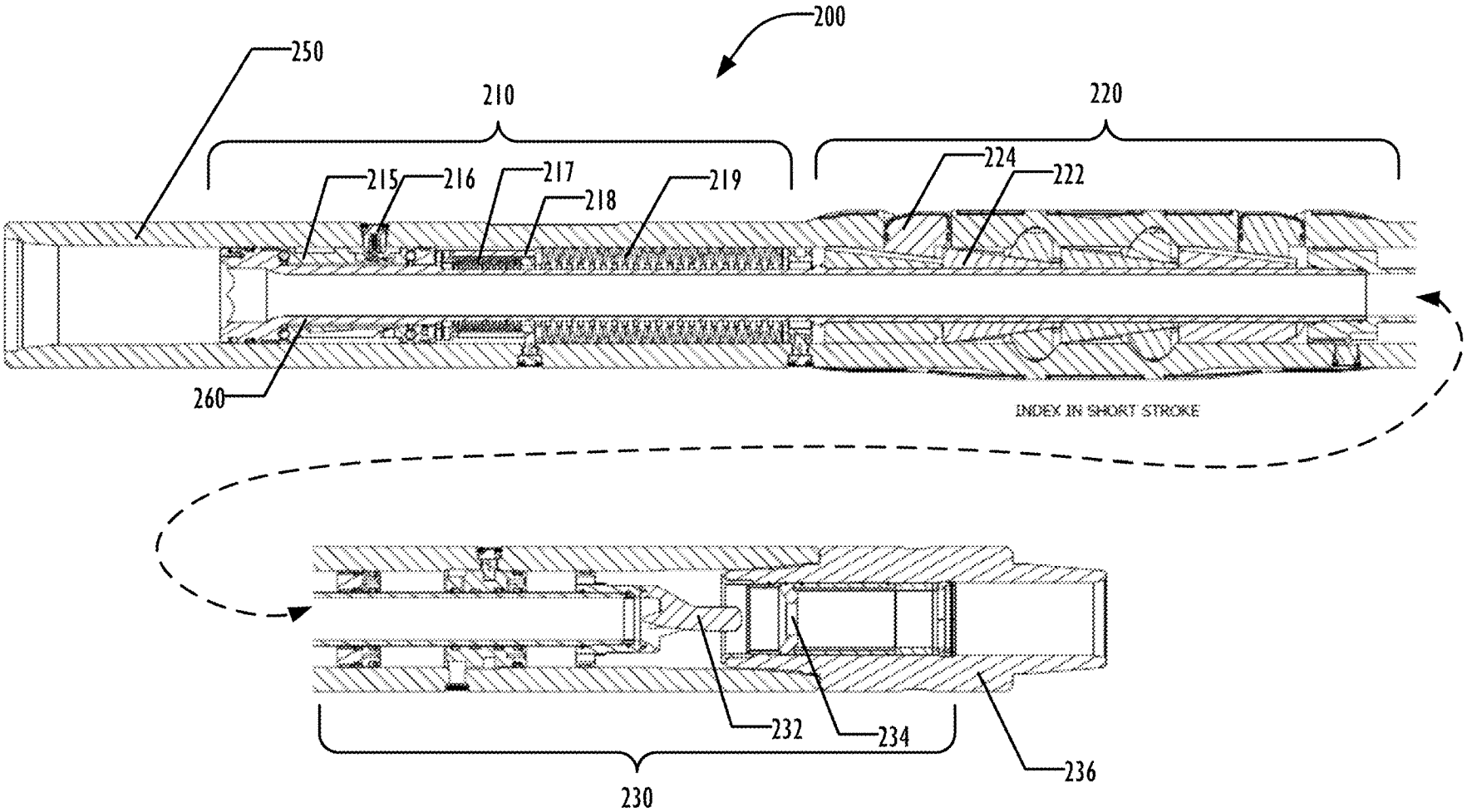

FIG. 4 illustrates the downhole tool assembly 200 indexed in a short stroke position (in short loop track 840, as illustrated in FIGS. 8-12) in which the first spring 217 is compressed into sleeve 218, but the pressure is not sufficient to compress the second spring 219. In this position, the poppet 232 does not engage with the orifice 234. The ramps 222 are partially urging the pistons radially outward in this position, but the pistons 224 do not extend out of the outer mandrel 250.

Figure 5:
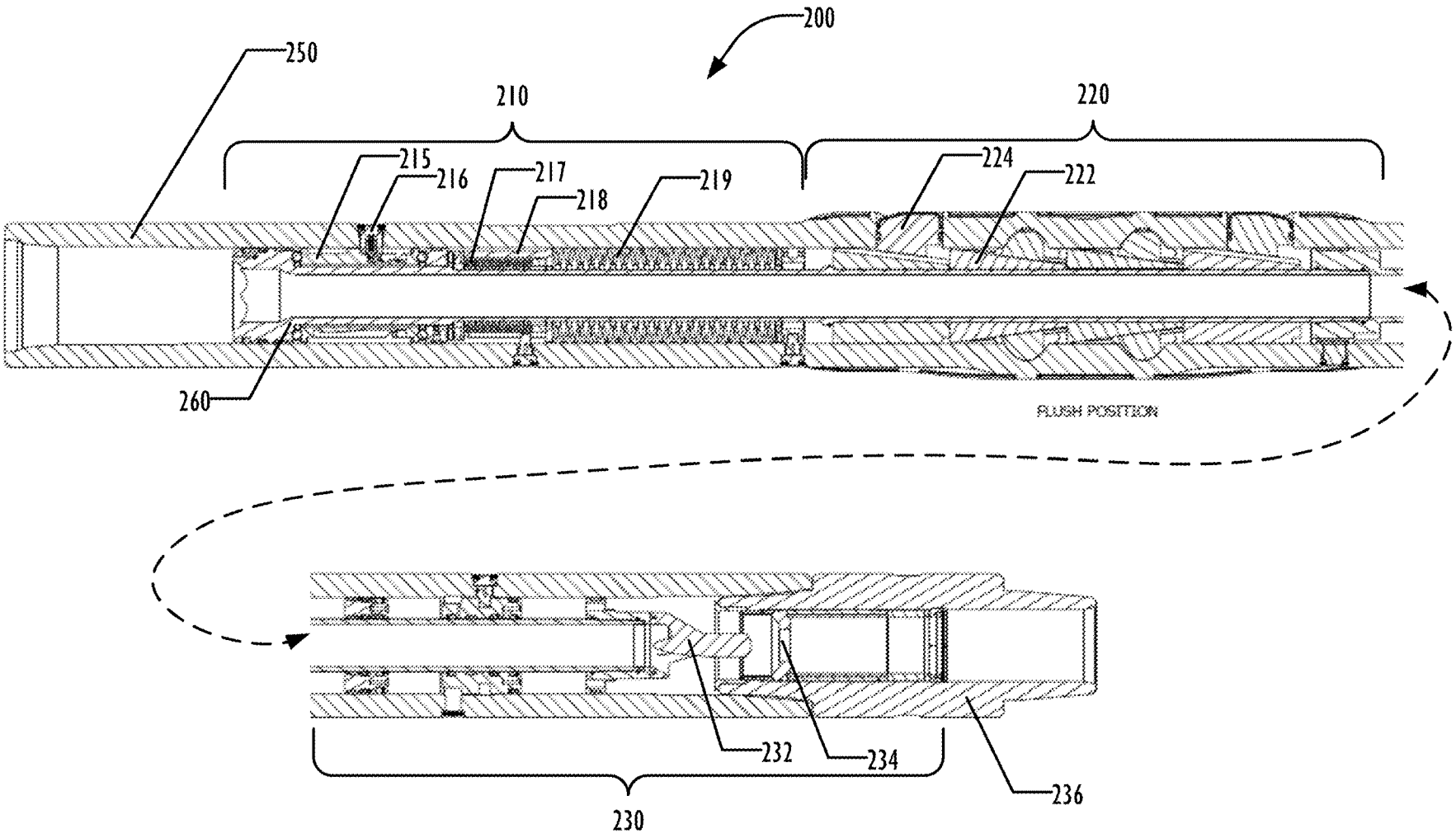

FIG. 5 illustrates the downhole tool assembly 200 indexed in a flush position in which the first spring 217 is compressed into sleeve 218 and the second spring 219 is partially compressed. In this position, the poppet 232 does not engage with the orifice 234. The ramps 222 have urged the pistons radially outward to a position where the pistons 224 are flush with the outer mandrel 250 body. In this position, any additional pressure force is supported by the pin 216 and the second spring 219 is prevented from compressing further.

Figure 6:
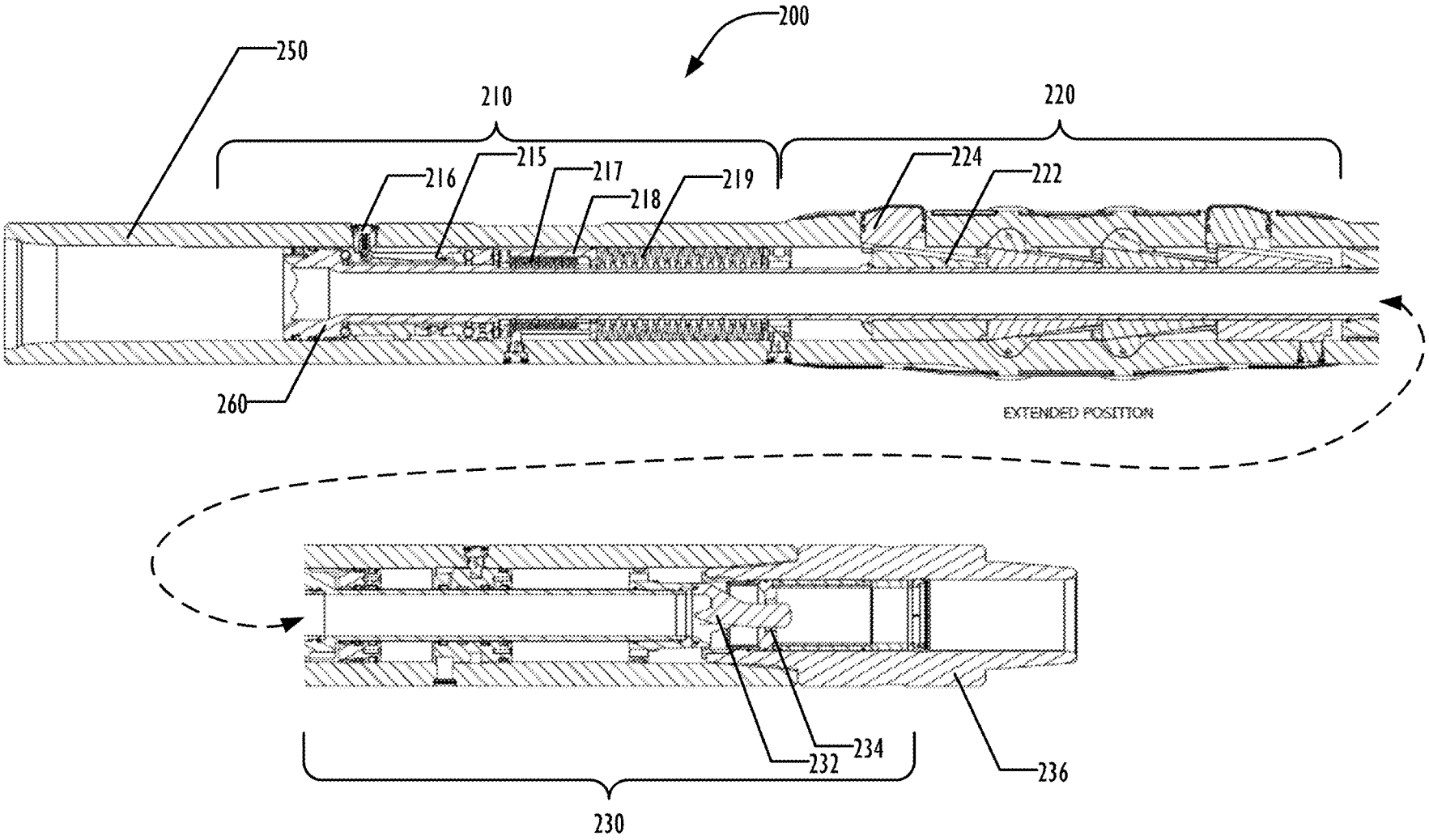

FIG. 6 illustrates the downhole tool assembly 200 indexed in an extended position in which the first spring 217 is compressed into the sleeve 218 and the second spring 219 is further compressed. In this position, the poppet 232 engages with the orifice 234, restricting fluid flow through the bore of the downhole tool assembly 200. The ramps 222 are urging the pistons 224 radially outward in this position so the pistons 224 may engage with the borehole. In this position, any additional pressure force is supported by the pin 216 and the second spring 219 is prevented from compressing further.

Figure 7:
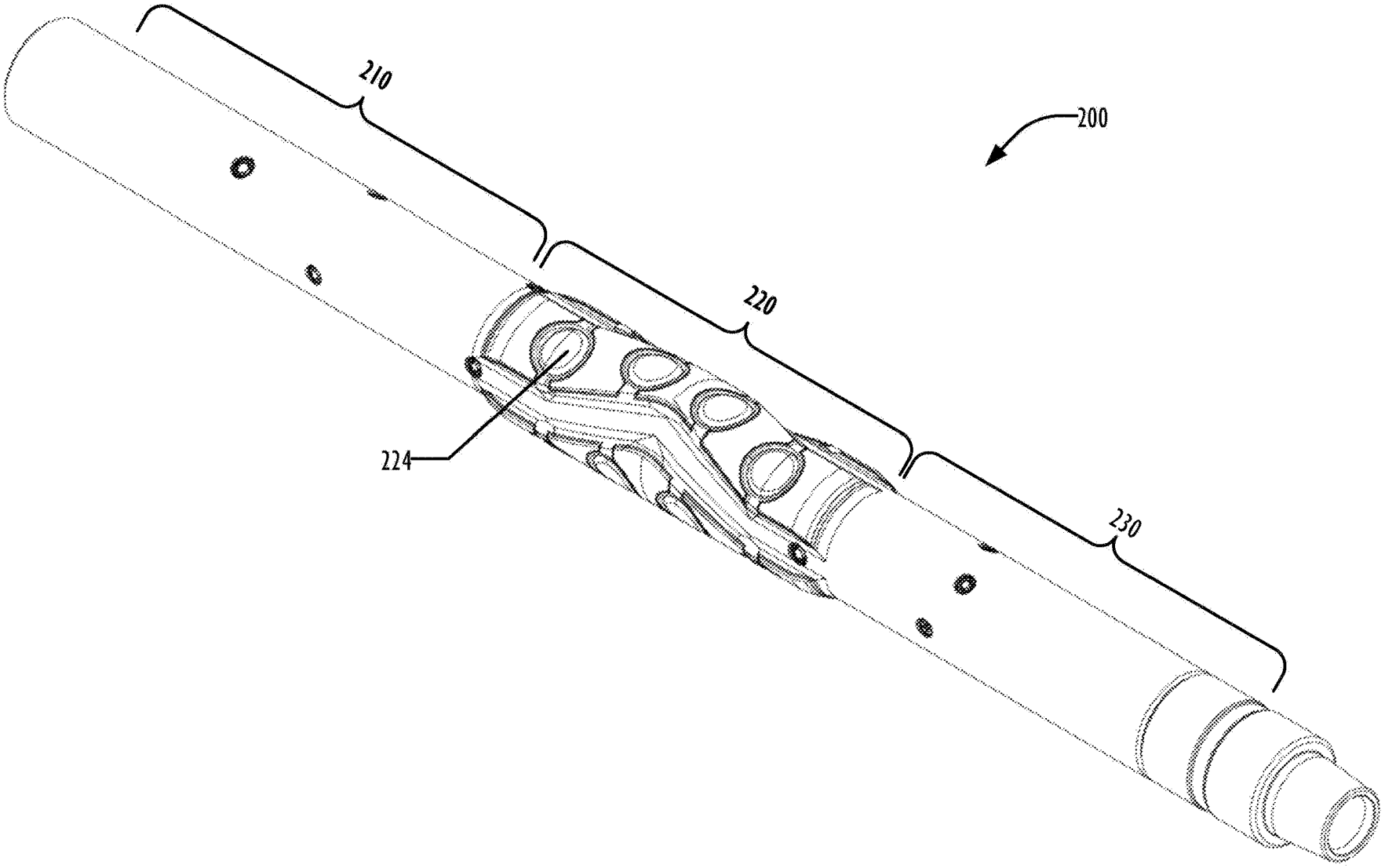
FIG. 7 is an isometric view of the downhole tool of FIGS. 2-6 according to one embodiment.

FIG. 7 is an isometric view of the downhole tool assembly 200 of FIGS. 2-6 according to one embodiment, illustrating indexing control section 210, stabilizer section 220, and fluid flow control section 230. Although six pistons 224 are visible in the stabilizer section 220 of FIG. 7, one of skill in the art will understand that additional pistons 224 are present around the circumference of the stabilizer section 220.

Figure 8:
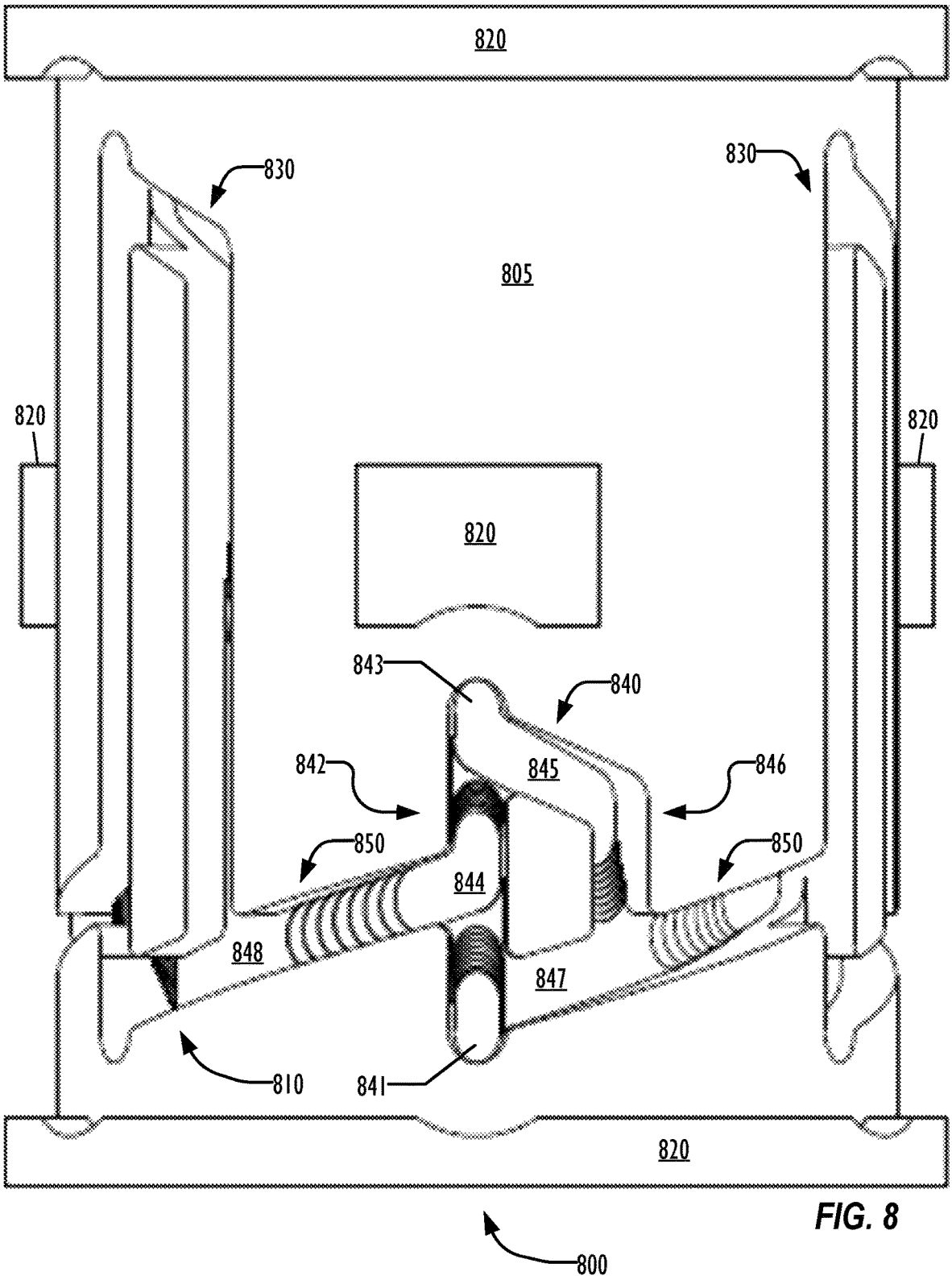
FIG. 8 is a side view of a barrel cam in a first rotational position according to one embodiment.
Figure 9:
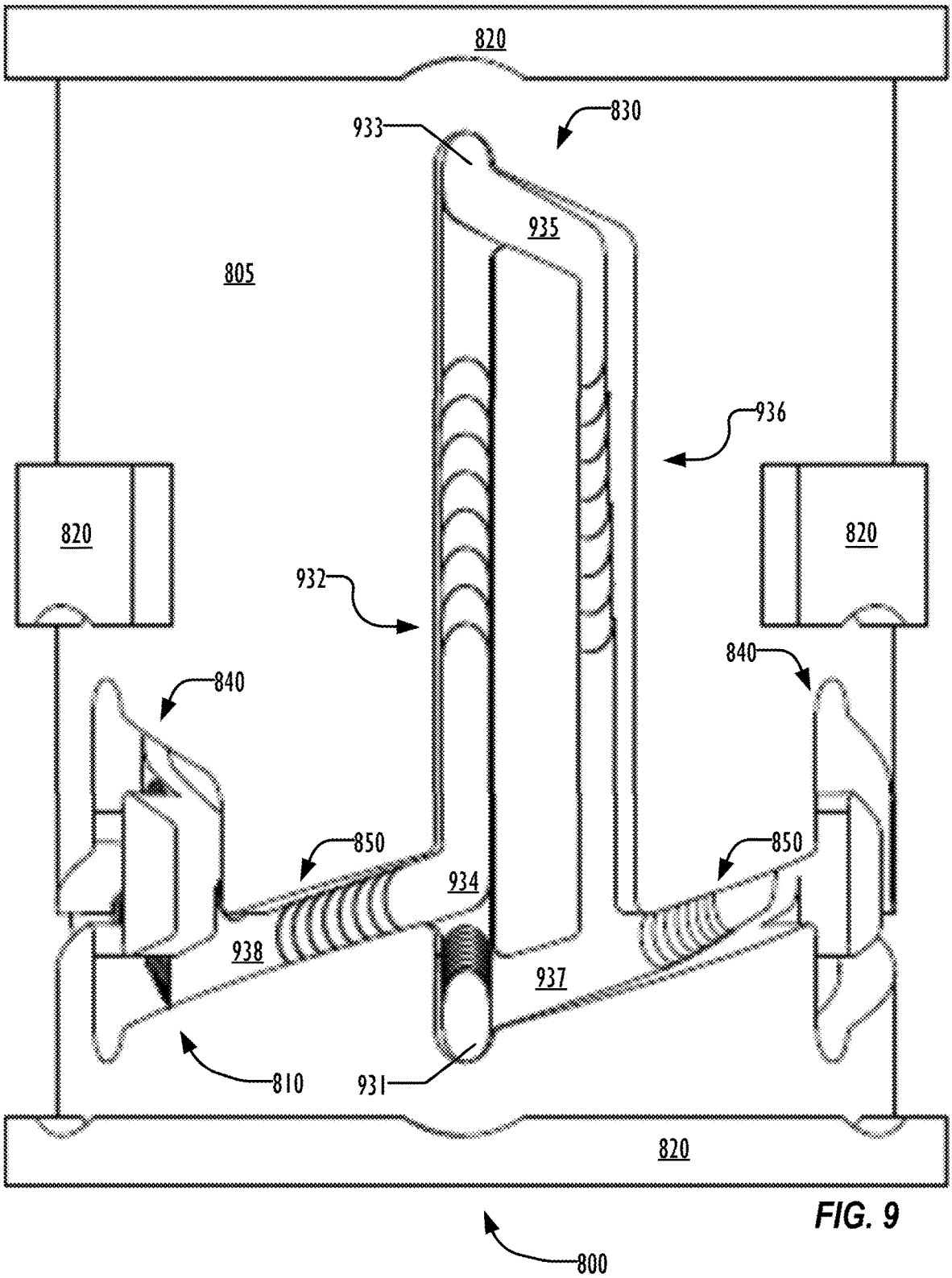
FIG. 9 is a side view of the barrel cam of FIG. 8 in a second rotational position according to one embodiment.

FIGS. 8-9 are two side views of a barrel cam 800 according to one embodiment, corresponding to the barrel cam 215 of FIGS. 2-6. As illustrated in FIGS. 8-9 a cam track 810 is formed as a groove in a body 805 of the barrel cam 800. The cam track may be milled or otherwise formed into the body 805. Circumferentially positioned about the body 805 are a plurality of stops 820 that prevent the pin 216 from moving either uphole or downhole beyond the stop, even if somehow the pin 216 escapes from the cam track 810. In operation, the pin 216 extends into and travels along the cam track 810. This movement of pin 216 in the cam track 810 may cause rotation of the barrel cam 800 and the inner mandrel 260 relative to the outer mandrel 250. In addition, the pin 216 may move within the cam track 810 in an uphole or downhole direction, depending on fluid pressure against the barrel cam 800 and pressure from the first spring 217 and the second spring 219. The cam track 810 provides a smooth track for the pin 216, avoiding jams or sticking in the cam track 810. Portions of the cam track 810 are radially sloped and in some places, radial steps prevent pin 216 from moving backward along the cam track 810. The orientation and path of the cam track 810 are illustrative and by way of example only, and other cam tracks may be used, subject to the basic structure described below.

The basic structure of the cam track 810 is an alternating sequence of loop tracks of different lengths connected by transition tracks 850. Any number of tracks and transition tracks 850 may be provided. In one embodiment, the alternating sequence of loop tracks comprises alternating long loop tracks 830 and short loop tracks 840. The transition tracks 850 are not part of either the long loop tracks 830 or the short loop tracks 840 and provide a one-way transition path from one loop to the next. FIG. 8 best illustrates an example short loop track 840, while FIG. 9 best illustrates a long loop track 830. As urged by fluid and spring pressure, the pin 216 may traverse either a long loop track 830 or a short loop track 840 any number of times, moving the barrel cam 800 in an uphole or downhole direction and rotating the barrel cam 800 as the pin 216 traverses the long loop track 830 or short loop track 840. However, the cam track 810 is manufactured to prevent reverse movement along a transition track 850.

Focusing now on the short loop track 840 of FIG. 8, increased fluid pressure will cause pin 216 to traverse the path from resting position 841 along path 842 towards resting position 843. A step 844 prevents backward movement of pin 216 towards resting position 841. When pin 216 is in resting position 843, reducing fluid pressure allows pin 216 to traverse paths 845, 846, and 847, ending back in resting position 841. Resting position 843 is stepped down from path 842, preventing reverse traversal of path 842 once pin 216 reaches resting position 843. This traversal may be performed repeatedly as many times as desired.

If fluid pressure is reduced while pin 216 is traversing path 842 before reaching resting position 843, however, pressure from first spring 217, second spring 219, or both may push the barrel cam 215 in an uphole direction, causing pin 216 to traverse back through path 842, where step 844 prevents further movement towards resting position 841, so pin 216 instead traverses transition track 848 towards an adjacent long loop track 830. Transition track 848 is sloped towards the adjacent long loop track 830. Typically, this is accomplished by increasing fluid pressure by an amount less than necessary to urge the barrel cam 215 downhole far enough to reach resting position 843. Thus, after repeatedly cycling the barrel cam 215 by increasing and decreasing fluid pressure resulting in repeated traversals of the short loop track 840, the barrel cam 215 may be indexed toward the adjacent long loop track 830.

FIG. 9 illustrates a long loop track 830 which is connected on both sides to two short loop tracks 840 with transition track 850. The structure of the long loop track 830 is similar to that of the short loop track 840 described above, but extends further in an uphole direction, allowing the barrel cam 215 to move further downhole under fluid pressure, resulting in the downhole tool assembly 200 reaching the extended position illustrated in FIG. 6. In most embodiments, the activated position will be when the pin 216 is at the end of the long loop track 830, in resting position 933. However, embodiments may activate the downhole tool when the pin 216 is in resting position 843 of the short loop track 840.

Increased fluid pressure will cause pin 216 to traverse the path from resting position 931 along path 932 towards resting position 933. Uphole from resting position 931, a step 934 prevents backward movement of the pin 216 towards resting position 931. When pin 216 is in resting position 933, reducing fluid pressure allows pin 216 to traverse paths 935, 936, and 937, ending back in resting position 931. Resting position 933 is stepped down from path 932, preventing reverse traversal of path 932 once pin 216 reaches resting position 933. This traversal may be performed repeatedly as many times as desired.

If fluid pressure is reduced while pin 216 is traversing path 932 before reaching resting position 933, however, pressure from first spring 217, second spring 219, or both may push the barrel cam 215 in an uphole direction, causing pin 216 to traverse back through path 932, where step 934 prevents further movement towards resting position 931, so pin 216 instead traverses transition track 938 towards an adjacent short loop track 840. Transition track 938 is sloped towards the adjacent short loop track 840. Typically, this is accomplished by increasing fluid pressure by an amount less than necessary to urge the barrel cam 215 downhole far enough to reach resting position 933. Thus, after repeatedly cycling the barrel cam 215 by increasing and decreasing fluid pressure resulting in repeated traversals of the long loop track 830, the barrel cam 215 may be indexed toward the adjacent short loop track 840.

Figure 10:
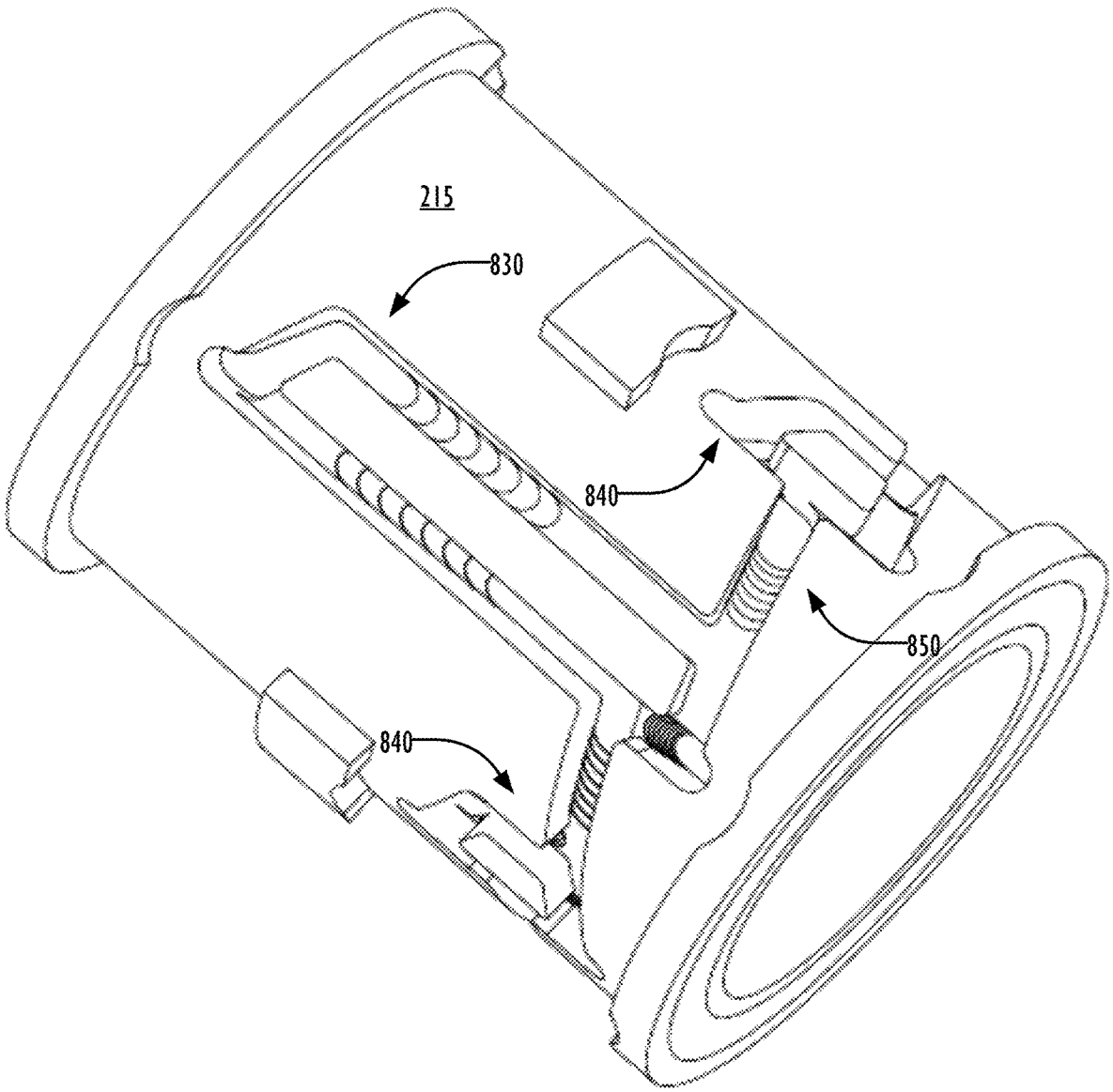
FIG. 10 is an isometric view of the barrel cam of FIG. 8 in a first rotational position according to one embodiment.
Figure 11:
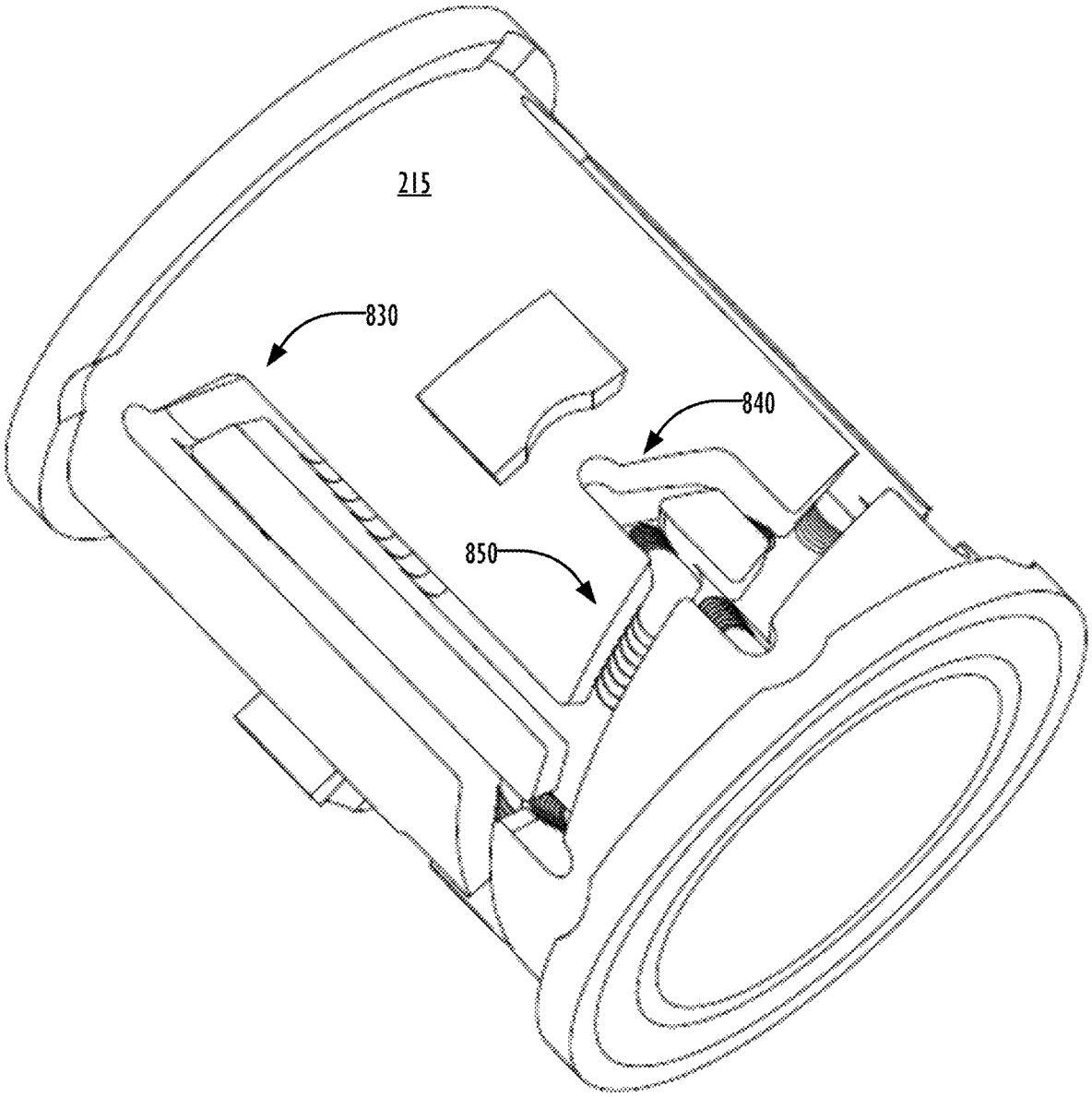
FIG. 11 is an isometric view of the barrel cam of FIG. 8 in a second rotational position according to one embodiment.
Figure 12:
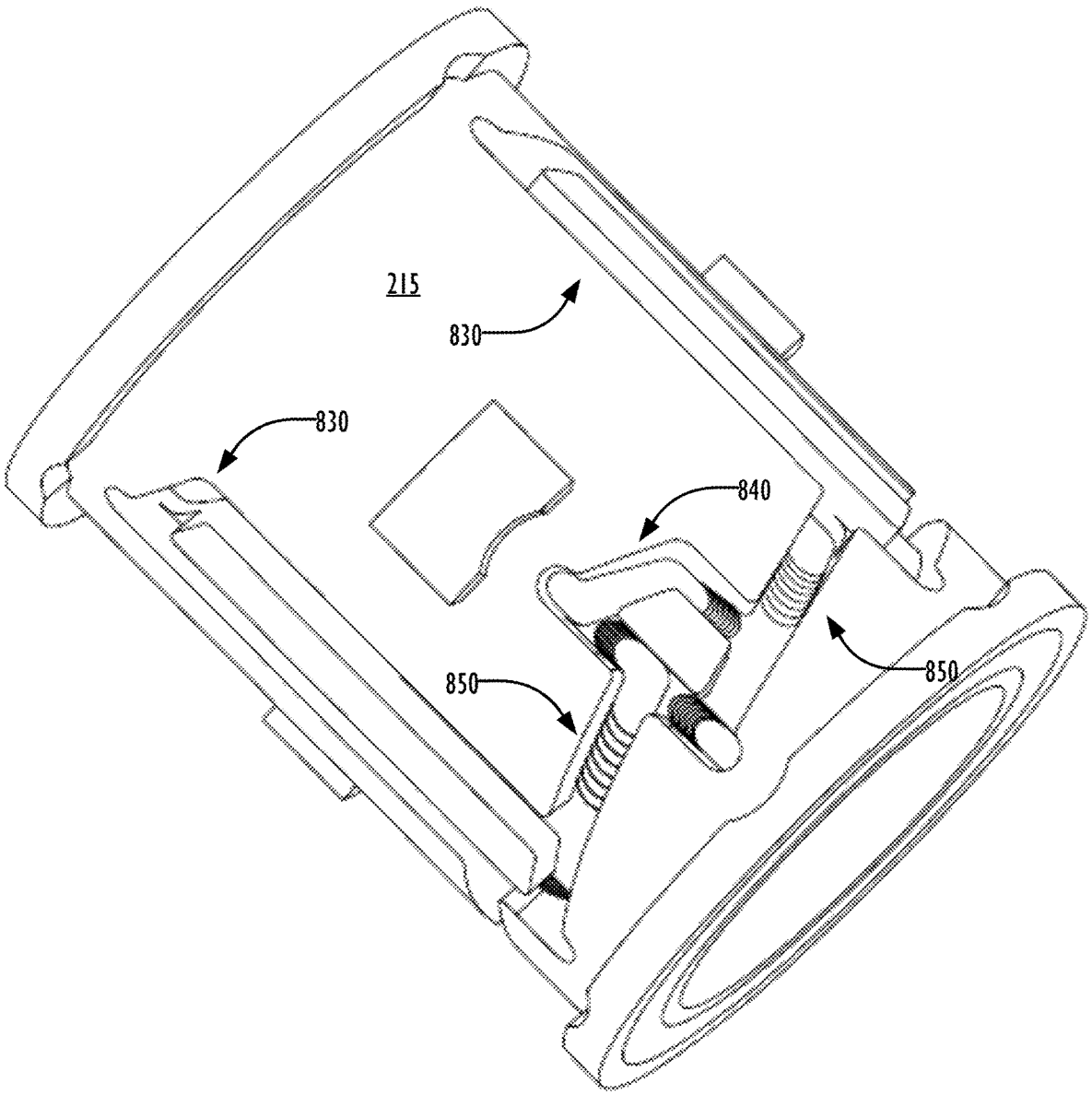
FIG. 12 is an isometric view of the barrel cam of FIG. 8 in a third rotational position according to one embodiment.

FIGS. 10-12 are isometric views of the barrel cam 215 in three rotational positions of the barrel cam 215, illustrating the relative positions of the sequence of long loop tracks 830, short loop tracks 840, and transition tracks 850 on the circumference of the example barrel cam 215.

Figure 13:
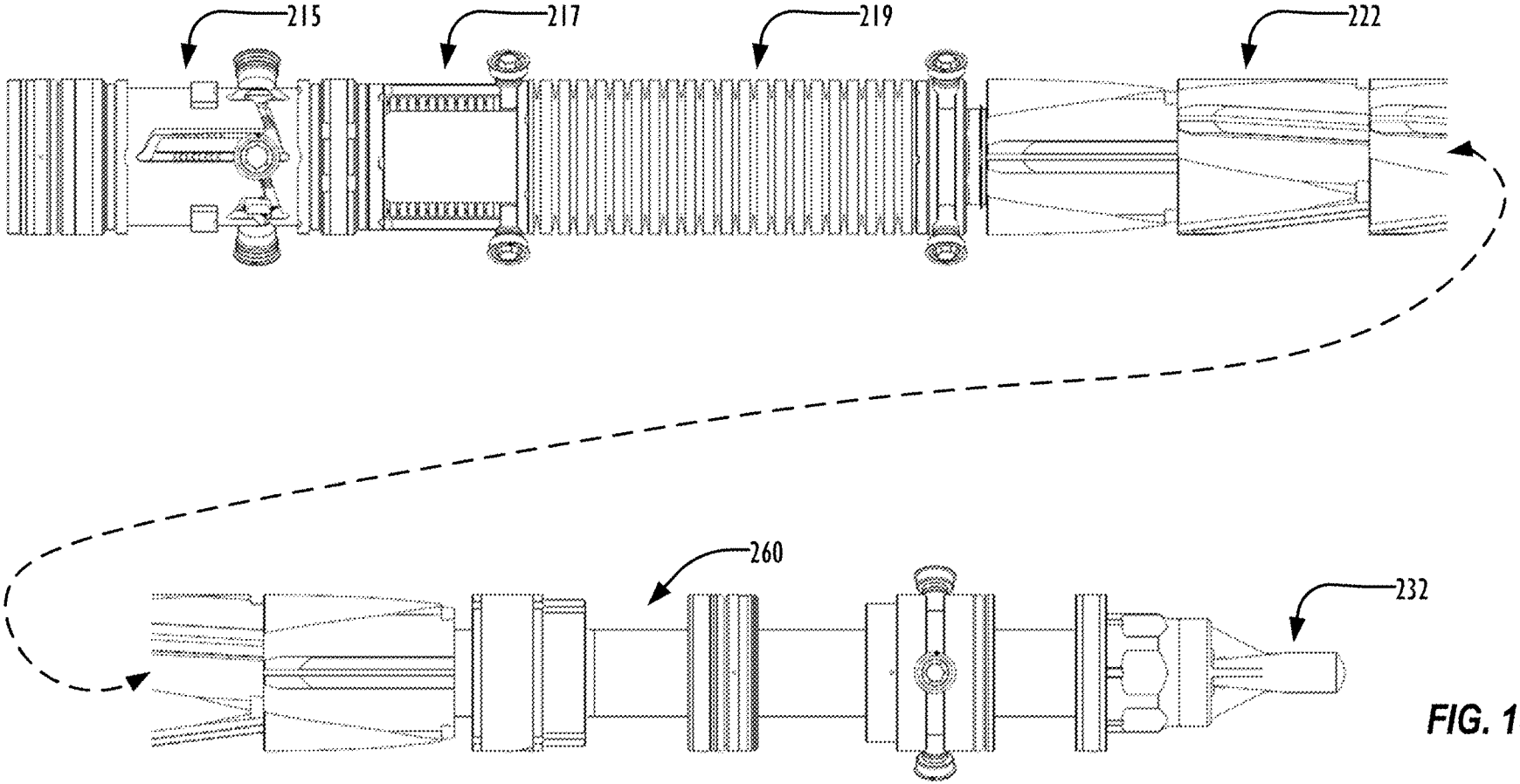
FIG. 13 is a side view of an inner portion of the downhole tool of FIG. 2 in a first rotational position according to one embodiment.
Figure 14:
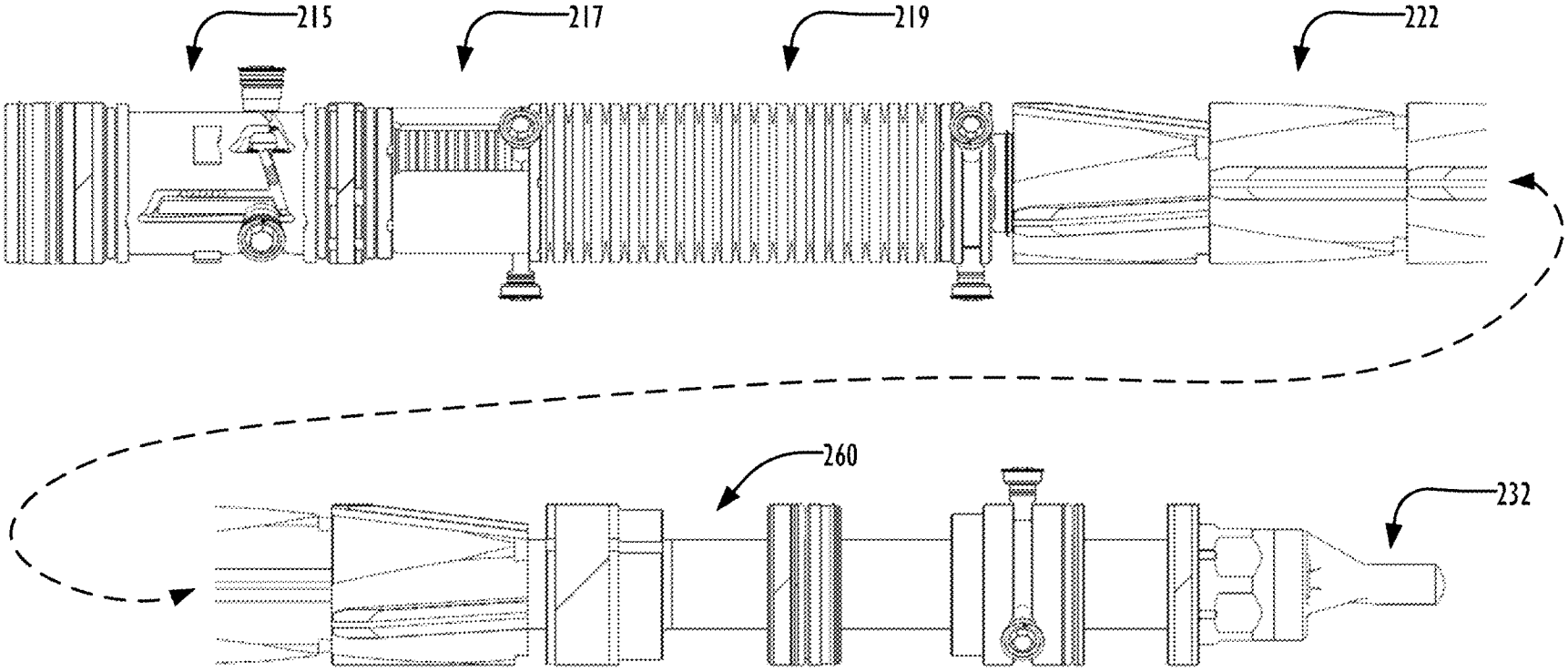
FIG. 14 is a side view of the inner portion of FIG. 13 in a second rotational position according to one embodiment.

FIGS. 13-14 are two side views at different rotational positions of the inner mandrel 260 on which are disposed the barrel cam 215, the first spring 217, the second spring 219, and ramps 222, and the poppet 232. One of skill in the art will understand that various seals, bearings, and other features are illustrated in FIG. 2 and FIGS. 13-14 may be employed to help position the inner mandrel 260 within the outer mandrel 250, but are not individually identified in the figures.

Although described above in terms of a single pin 216, typically a plurality of pins 216 are employed, spaced around the outer mandrel 250, with each pin 216 traversing either a long loop track 830 or a short loop track 840, depending on the index position of the barrel cam 215. For example, as illustrated in FIGS. 13-14, there are three long loop tracks 830, alternating with three short loop tracks 840, and three pins 216. Each of the pins 216 typically comprises a bushing housing a spring-loaded pin portion. By using a plurality of pins 216, force on the pins 216 is distributed and even loading is placed on the barrel cam 215. In addition, a plurality of pins 216 allows sufficient strength to handle high loading on the barrel cam 215 when fluid pressure is high.

Although as described above traversal of the loop tracks is generally done in a clockwise direction, embodiments may be manufactured in which the loop tracks are traversed in a counterclockwise direction, with the transition tracks on the opposite side of the loop tracks as illustrated in the drawings.

By employing a barrel cam 215 as illustrated and described above as an indexing control system, a downhole tool assembly 200 may be activated and deactivated repeatedly using purely mechanical elements with hydraulic pressure exerted by drilling mud. This provides an advantage over previous techniques that employed darts, balls, or the like, which could only be activated or deactivated a limited number of times, without the need for complex electronic control systems. Although described and illustrated in terms of a stabilizer, as explained above the techniques described herein can be used in a variety of other downhole tools where such repeated activation and deactivation cycles may be desired in either onshore or offshore settings.

In addition to providing a method for repeatedly activating or deactivating the downhole tool assembly, because activation and deactivation are signaled by changes in fluid pressure, such as by turning the mud pump off and on, activation and deactivation can be achieved faster with the system described above, reducing costs for the drilling operator. Balls and darts can take a relatively long time to flow through the drilling mud downhole at the relevant drilling depths. In contrast, changes in fluid pressure traverse through the drilling mud at the speed of sound, so may reach the indexing control system much faster than a ball or dart. Furthermore, by using an alternating sequence of two different length loops, the indexing control system can potentially cause two different activation and deactivation sequences, each one controlled by a different one of the loop tracks described above.

While certain example embodiments have been described in detail and shown in the accompanying drawings, it is to be understood that such embodiments are merely illustrative of and not devised without departing from the basic scope thereof, which is determined by the claims that follow.

The invention claimed is:

1. A downhole assembly, comprising:

an outer mandrel defining a bore;

an inner mandrel disposed in the bore and being movable with axial movement in the bore in a first direction and a second direction in response to downhole pressures; and an indexing assembly arranged between the outer mandrel and the inner mandrel and having a continuous track and a pin, the continuous track defined circumferentially about the indexing assembly and having a first loop and a second loop formed therein, the first loop having a first resting position and a first active position, the second loop having a second resting position and a second active position, the pin being configured to traverse the continuous track, wherein the indexing assembly having the pin traversing the first loop is configured to control the axial movement of the inner mandrel between the first resting position and the first active position in response to one or more first repeatable sequences of the downhole pressures;

wherein the indexing assembly having the pin traversing the second loop is configured to control the axial movement of the inner mandrel between the second resting position and the second active position in response to one or more second repeatable sequences of the downhole pressures; and wherein the indexing assembly is configured to permit the pin to transition in the continuous track between the first loop and the second loop in response to an intermediate sequence of the downhole pressures.

2. The downhole assembly of claim 1, further comprising a first spring biasing the inner mandrel in the first direction and being compressed by the axial movement of the inner mandrel in the second direction, the first direction being upbore, the second direction being downbore.

3. The downhole assembly of claim 2, further comprising a second spring biasing the inner mandrel in the first direction, the second spring having a second spring force higher than a first spring force of the first spring, wherein the axial movement of the inner mandrel in the second direction compresses the second spring only after compressing the first spring.

4. The downhole assembly of claim 3, wherein the first spring is configured to allow the inner mandrel to move in the first direction and the second direction in response to the intermediate sequence of the downhole pressures to transition the pin in the continuous track between the first loop and the second loop.

5. The downhole assembly of claim 1, wherein the indexing assembly comprises a barrel cam disposed on the inner mandrel and being moveable in the axial movement with the inner mandrel, the barrel cam defining the continuous track disposed circumferentially about the barrel cam; and wherein the pin of the indexing assembly is disposed in a fixed position on the outer mandrel.

6. The downhole assembly of claim 5, wherein the barrel cam is rotatably supported on the inner mandrel.

7. The downhole assembly of claim 5, further comprising a sleeve movably disposed within the outer mandrel adjacent to the barrel cam;

a first spring disposed within the outer mandrel between the barrel cam and the sleeve and biasing the barrel cam in the first direction away from the sleeve; and a second spring disposed within the outer mandrel between the sleeve and a portion of the outer mandrel, the second spring biasing the sleeve, the first spring, and the barrel cam in the first direction away from a shoulder, the second spring having a second spring force higher than a first spring force of the first spring, wherein the axial movement of the barrel cam, at least in response to the intermediate sequence of the downhole pressures, at least partially compresses the first spring; and wherein the axial movement of the barrel cam, at least in response to the one or more first and second repeatable sequences of the downhole pressures, compresses the second spring only after the barrel cam compresses the first spring and bears on the sleeve.

8. The downhole assembly of claim 5, wherein the first loop and the second loop are part of a sequence of alternating loops formed in the continuous track about a circumference of the barrel cam.

9. The downhole assembly of claim 5, wherein the first resting position of the first loop and the second resting position of the second loop are defined at different lateral positions on the barrel cam and are defined at a same longitudinal height on the barrel cam; and wherein the first active position of the first loop and the second active position of the second loop are defined at different lateral positions on the barrel cam and are defined at different longitudinal heights on the barrel cam.

10. The downhole assembly of claim 5, wherein a first of the downhole pressures in the one or more first repeatable sequences urges the barrel cam in the second direction, the second direction being downbore, causing the pin to traverse a first portion of the first loop from the first resting position to the first active position, wherein a second of the downhole pressures in the one or more first repeatable sequences allows the barrel cam to move in the first direction, the first direction being upbore, causing the pin to traverse a second portion of the first loop from the first active position to the first resting position, wherein a third of the downhole pressures in the intermediate sequence urges the barrel cam to move in the second direction, causing the pin to traverse a part of the first portion of the first loop from the first resting position, wherein a fourth of the downhole pressures in the intermediate sequence allows the barrel cam to move in the first direction, causing the pin to traverse the part of the first portion of the first loop in a reverse direction and to transition to the second loop, and wherein a first step in the continuous track prevents traversal of the pin from the second loop back to the first loop.

11. The downhole assembly of claim 1, wherein a first distance between the first resting position and the first active position of the first loop is greater than a second distance between the second resting position and the second active position of the second loop.

12. The downhole assembly of claim 1, wherein the first loop comprises a first section connecting the first resting position to the first active position and comprises a second section connecting the first active position to the first resting position, the pin being configured to traverse the first section from the first resting position to the first active position with the axial movement of the inner mandrel in response a first of the downhole pressures in the one or more first repeatable sequences urging the inner mandrel in the second direction, the pin being configured to traverse the second section from the first active position to the first resting position with the axial movement of the inner mandrel in response a second of the downhole pressures in the one or more first repeatable sequences urging the inner mandrel in the first direction.

13. The downhole assembly of claim 12, wherein a step in the continuous track prevents traversal of the pin from the first active position back into the first section of the first loop.

14. The downhole assembly of claim 12, wherein the pin is configured to:

traverse the first section from the first resting position partially toward the first active position with the axial movement of the inner mandrel in response to a first intermediate of the downhole pressures in the intermediate sequence urging the inner mandrel in the second direction; and transition in the continuous track from the first section of the first loop to the second loop with the axial movement of the inner mandrel in response a second intermediate of the downhole pressures in the intermediate sequence urging the inner mandrel in the first direction.

15. The downhole assembly of claim 14, wherein a step in the continuous track prevents traversal of the pin in the first section back to the first resting position with the axial movement of the inner mandrel in response the second intermediate downhole pressure in the intermediate sequence urging the inner mandrel in the first direction.

16. The downhole assembly of claim 14, wherein a step in the continuous track prevents traversal of the of the pin from the second loop back to the first resting position of the first loop.

17. The downhole assembly of claim 1, comprising a downhole tool connected to the outer mandrel, the inner mandrel being configured to activate and deactivate the downhole tool.

18. The downhole assembly of claim 17, wherein the downhole tool comprises a stabilizer, a reamer, or a flow bypass assembly.

19. The downhole assembly of claim 1, wherein:

each of the one or more first repeatable sequences of the downhole pressures comprises a first of the downhole pressures configured to traverse the pin from the first resting position to the first active position of the first loop and comprises a second of the downhole pressures configured to traverse the pin from the first active position to the first resting position of the first loop;

each of the one or more second repeatable sequences of the downhole pressures comprises a third of the downhole pressures configured to traverse the pin from the second resting position to the second active position of the second loop and comprises a fourth of the downhole pressures configured to traverse the pin from the second active position to the second resting position of the first loop; and the intermediate sequence of the downhole pressures comprises a fifth of the downhole pressures configured to traverse the pin from a respective one of the first and second resting positions partially to a respective one of the first and second active positions of a respective one of the first and second loops and comprises a sixth of the downhole pressures configured to traverse the pin back to the other respective one of the first and second resting positions of the other respective one of the first and second loops.

20. The downhole assembly of claim 1, wherein the first loop is disposed circumferentially adjacent to the second loop about the indexing assembly.

21. A method for a downhole tool, comprising:

repeatedly operating the downhole tool in first operational conditions by subjecting an inner mandrel of the downhole tool to one or more first repeatable sequences of downhole pressures, traversing a pin of an indexing assembly in a first loop of a continuous cam track of the indexing assembly, and controlling axial movement of the inner mandrel between a first resting position and a first active position of the first loop in response to the one or more first repeatable sequences of the downhole pressures;

repeatedly operating the downhole tool in second operational conditions by subjecting the inner mandrel of the downhole tool to one or more second repeatable sequences of the downhole pressures, traversing the pin of the indexing assembly in a second loop of the continuous cam track of the indexing assembly, and controlling the axial movement of the inner mandrel between a second resting position and a second active position of the second loop in response to the one or more second repeatable sequences of the downhole pressures; and selectively transitioning the pin of the indexing assembly in the continuous cam track between the first loop and the second loop in response to an intermediate sequence of the downhole pressures.

22. The method of claim 21, wherein controlling the axial movement of the inner mandrel in response to the one or more first and second repeatable sequences of the downhole pressures comprises: first compressing a first spring, and subsequently compressing a second spring having a second spring force higher than a first spring force of the first spring; and wherein selectively transitioning the pin of the indexing assembly in the continuous cam track between the first loop and the second loop in response to the intermediate sequence of the downhole pressures comprises controlling the axial movement of the inner mandrel by compressing only the first spring.

* * * * *